US006202753B1

(12) United States Patent
Baugh

(10) Patent No.: US 6,202,753 B1
(45) Date of Patent: Mar. 20, 2001

(54) SUBSEA ACCUMULATOR AND METHOD OF OPERATION OF SAME

(76) Inventor: Benton F. Baugh, 14626 Oak Bend, Houston, TX (US) 77079-6441

( * ) Notice: Subject to any disclaimer, the term of this patent is extended or adjusted under 35 U.S.C. 154(b) by 0 days.

(21) Appl. No.: 09/216,816

(22) Filed: Dec. 21, 1998

(51) Int. Cl.[7] ..... E21B 33/037; E21B 33/064; E21B 34/04; E21B 43/01

(52) U.S. Cl. ..... 166/364; 166/368

(58) Field of Search ..... 166/358, 363, 166/364, 368, 355, 335

(56) References Cited

U.S. PATENT DOCUMENTS 3,677,001 * 7/1972 Childers et al. ..... 60/398
4,777,800 * 10/1988 Hay, II ..... 60/593

* cited by examiner

*Primary Examiner*—Eileen D. Lillis
*Assistant Examiner*—Tara L. Mayo

(57) ABSTRACT

An accumulator for use in deepwater operational and control systems which uses a differential between a high pressure ambient pressure source such as sea water pressure and a low pressure source such as a chamber holding vacuum or atmospheric pressure to provide storage and delivery of hydraulic power for operation of equipment.

17 Claims, 3 Drawing Sheets

SUBSEA ACCUMULATOR AND METHOD OF OPERATION OF SAME

BACKGROUND OF THE INVENTION

The field of this invention of that of deepwater accumulators for the purpose of providing a supply of pressurized working fluid for the control and operation of equipment. The equipment is typically blowout preventers (BOP) which are used to shut off the well bore to secure an oil or gas well from accidental discharges to the environment, gate valves for the control of flow of oil or gas to the surface or to other subsea locations, hydraulically actuated connectors and similar devices. The fluid to be pressurized is typically an oil based product or a water based product with added lubricity and corrosion protection.

Currently accumulators come in three styles which operate on a common principle. The principle is to precharge them with pressurized gas to a pressure at or slightly below the anticipated minimum pressure required to operate equipment. Fluid can be added to the accumulator, increasing the pressure of the pressurized gas and the fluid. The fluid introduced into the accumulator is therefore stored at a pressure at least as high as the precharge pressure and is available for doing hydraulic work.

The accumulator styles are bladder type having a balloon type bladder to separate the gas from the fluid, the piston type having a piston sliding up and down a seal bore to separate the fluid from the gas, and a float type with a float providing a partial separation of the fluid from the gas and for closing a valve when the float approaches the bottom to prevent the escape of gas.

Accumulators providing typical 3000 p.s.i. working fluid to surface equipment can be of a 5000 p.s.i. working pressure and contain fluid which raises the precharge pressure from 3000 p.s.i. to 5000 p.s.i.

As accumulators are used in deeper water, the efficiency of conventional accumulators is decreased. In 1000 feet of seawater the ambient pressure is approximately 465 p.s.i. For an accumulator to provide a 3000 p.s.i. differential at 1000 ft. depth, it must actually be precharged to 3000 p.s.i. plus 455 p.s.i. or 3465 p.s.i.

At slightly over 4000 ft. water depth, the ambient pressure is almost 2000 p.s.i., so the precharge would be required to be 3000 p.s.i. plus 2000 p.s.i. or 5000 p.s.i. This would mean that the precharge would equal the working pressure of the accumulator. Any fluid introduced for storage would cause the pressure to exceed the working pressure, so the accumulator would be non-functional.

Another factor which makes the deepwater use of conventional accumulators impractical is the fact that the ambient temperature decreases to approximately 35 degrees F. If an accumulator is precharged to 5000 p.s.i. at a surface temperature of 80 degrees F., approximately 416 p.s.i. precharge will be lost simply because the temperature was reduced to 35 degrees F. Additionally, the rapid discharge of fluids from accumulators and the associated rapid expansion of the pressurizing gas causes a natural cooling of the gas. If an accumulator is quickly reduced in pressure from 5000 p.s.i. to 3000 p.s.i. without chance for heat to come into the accumulator (adiabatic), the pressure would actually drop to 2012 p.s.i.

SUMMARY OF THE INVENTION

The object of this invention is to provide an accumulator for deepwater ocean service which does not lose its precharge differential relative to ambient pressures due to high ambient pressures.

A second object of the present invention is to provide an accumulator for deepwater ocean service which does not lose its precharge relative to ambient pressures due to low ambient pressures.

A third object of the present invention is to provide an accumulator which has a relatively constant discharge pressure relative to ambient pressure irrespective of the ambient pressure.

Another object of the present invention is to provide for actuation of subsea equipment by taking advantage of the inherent pressure of deepwater seawater in relationship to a vacuum.

DESCRIPTION OF THE PREFERRED EMBODIMENT

Figure 1:
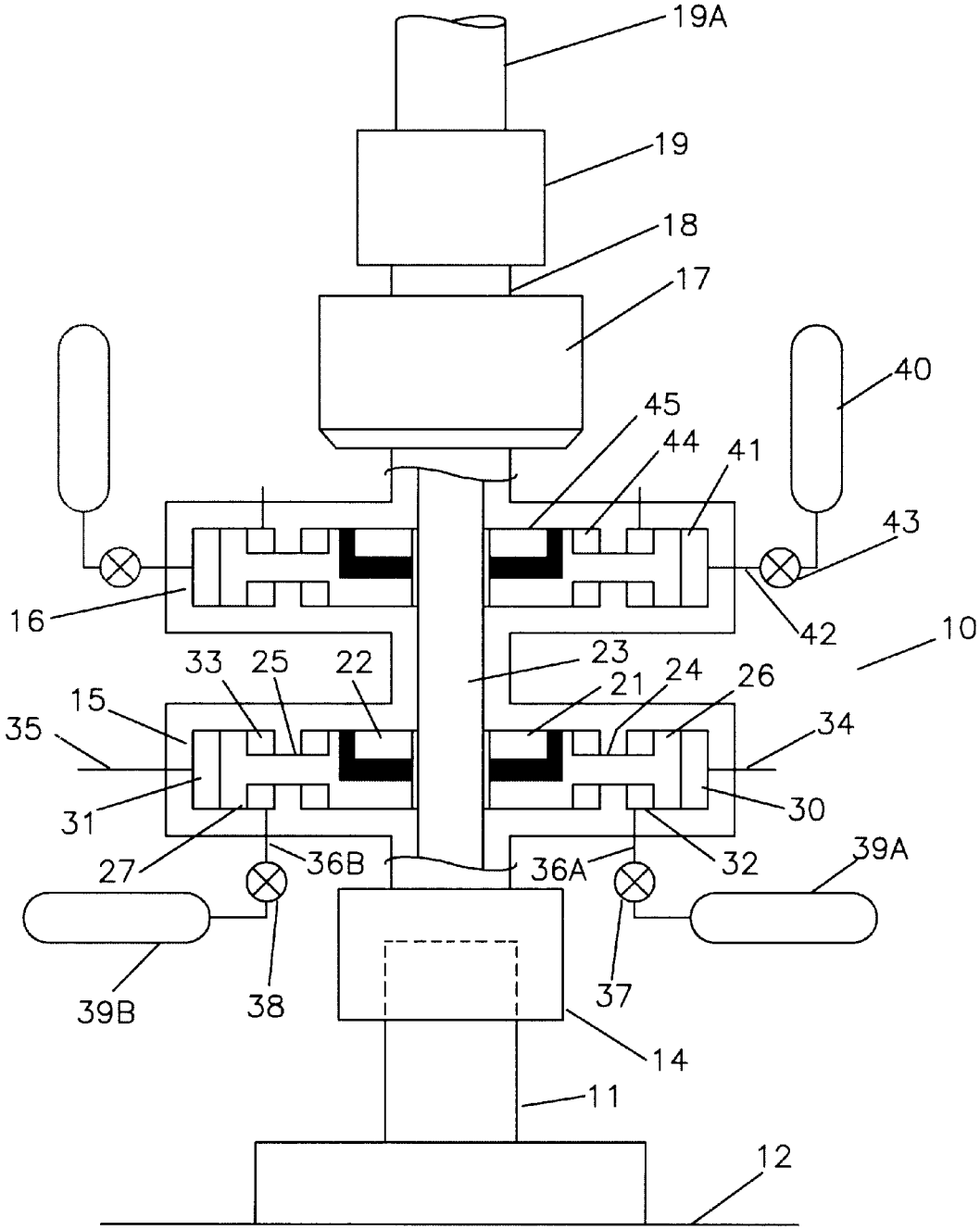
FIG. 1 is a partial section thru a subsea blowout preventer stack showing applications of principles of this invention.

Referring now to FIG. 1, a blowout preventer (BOP) stack 10 is landed on a subsea wellhead system 11, which is supported above mudline 12. The BOP stack 10 is comprised of a wellhead connector 14 which is typically hydraulically locked to the subsea wellhead system 11, multiple ram type blowout preventers 15 and 16, an annular blowout preventer 17 and an upper mandrel 18. A riser connector 19, and a riser 19*a* to the surface are attached for communicating drilling fluids to and from the surface.

Blowout preventer 15 includes a body 20, rams 21 and 22 for moving into the vertical bore 23 for sealing, rods 24 and 25, pistons 26 and 27, outer chamber 30 and 31, and inner chambers 32 and 33. Lines 34 and 35 vent the outer chambers 30 and 31 to the seawater. Lines 36*a* and 36*b* communicate the inner chambers 32 and 33 with low pressure chambers 39*a* and 39*b* thru valves 37 and 38. If the valves 37 and 38 are opened, the differential pressure between the seawater pressure in outer chambers 30 and 31 and the low pressure in inner chambers 32 and 33 will be available to move the rams 21 and 22 toward each other to close off the vertical bore 23.

Alternately, blowout preventer 16 shows that an alternate accumulator 40 of this invention being connected to one of the outer cavities 41 thru line 42 and valve 43. The inner chamber 44 is shown communicating with the seawater pressure. If the valve 43 is opened, fluid pressure from accumulator 40 will move the ram 45 toward the center of the vertical bore (and seal against an opposing ram similarly moved).

Figure 2:
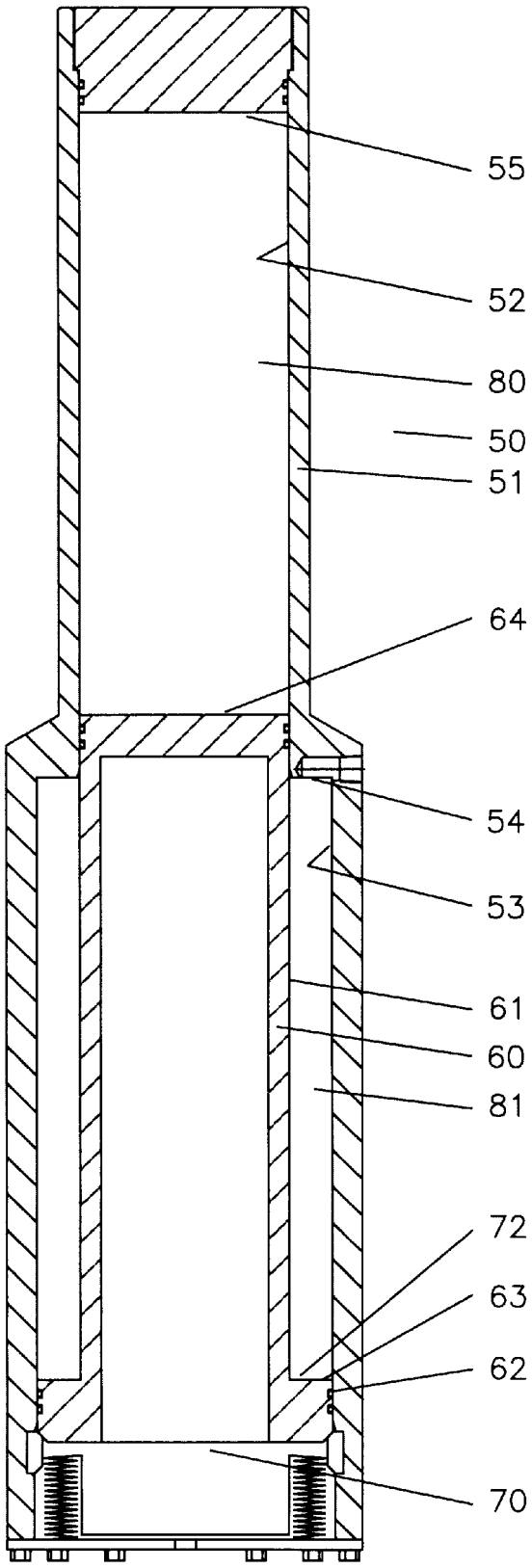
FIG. 2 is a section thru a first accumulator style which provides no gas precharge, but rather takes all energy from the seawater pressure.

Referring now to FIG. 2, accumulator 50 has a body 51 with a smaller bore 52, a large bore 53, an annular bulkhead 54, and a bulkhead 55. Ram 60 has a smaller diameter 61, a large diameter 62, and annular bulkhead 63, and an end 64.

Assume smaller bore 52 and large bore 53 are sized in a diametrical ratios of 0.707/1 which results in the larger bore piston area 70 having twice the area of the smaller bore piston area 71, and therefore the annular piston area 72 being the difference between the other two bores has a area equal to the smaller bore piston area 71.

Larger bore piston area 70 is responsive to the seawater pressure. Smaller bore piston area is responsive to the pressure in chamber 80 which can be a very low pressure or a vacuum. Annular piston area 72 is responsive to pressure in annular chamber 81.

Assume that the accumulator is in 10,000 feet of seawater. The seawater pressure is 10,000*0.465 p.s.i./ft. or 4650 p.s.i. The pressure in chamber 81 is twice the seawater pressure or 9300 p.s.i., or 4650 p.s.i. above the deep sea ambient pressure of 4650 p.s.i.

Assuming a vacuum in chamber 80, the pressure in chamber 81 remains at 4650 p.s.i. above ambient for the full discharge of fluids from that chamber.

This type of accumulator has no precharge and no output pressure at the surface, but utilizes the inherent pressure of deep sea water to generate an operational pressure differential with respect to a vacuum.

Figure 3:
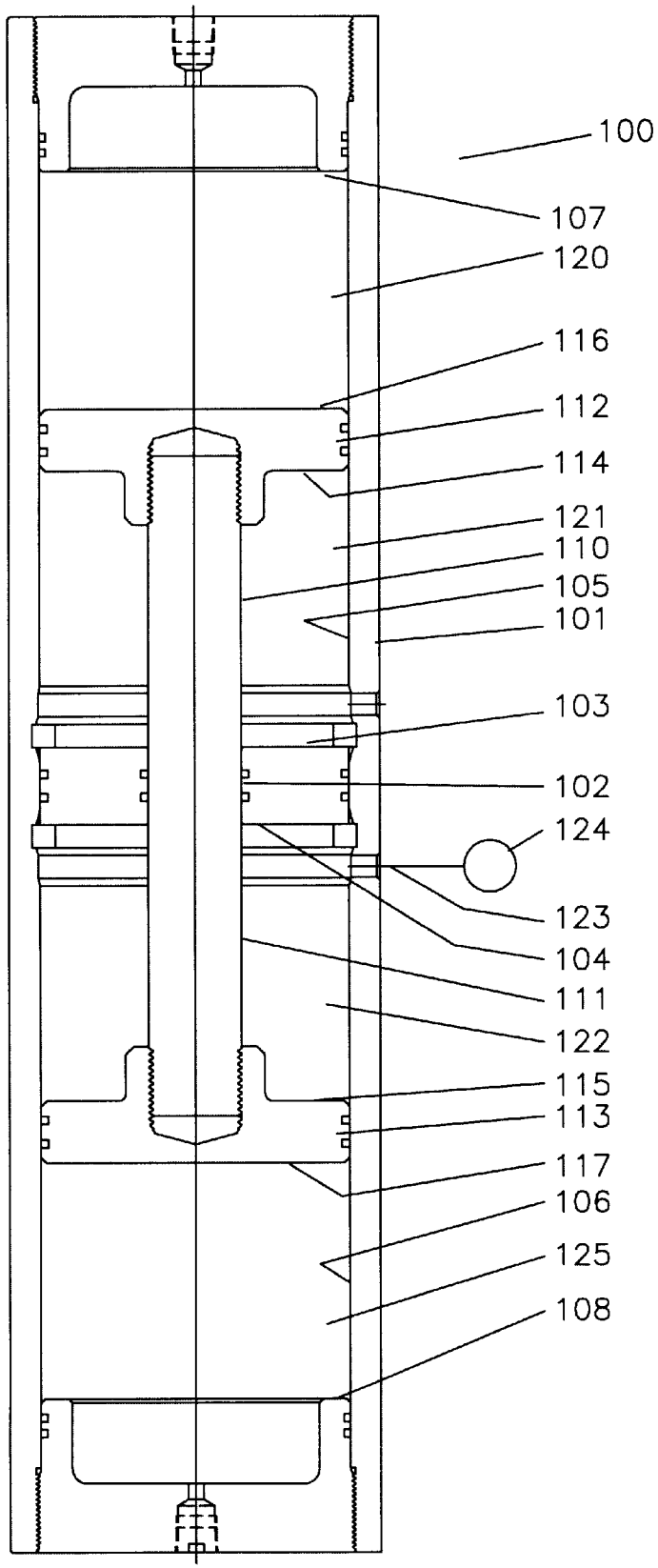
FIG. 3 is a section thru a second accumulator style that provides a nitrogen precharge plus taking energy from seawater pressure.

Referring now to FIG. 3, accumulator 100 has a body 101, a smaller bore 102, an upper annular bulkhead 103, a lower annular bulkhead 104, an upper larger bore 105, a lower larger bore 106, and upper bulkhead 107, and a lower bulkhead 108. Piston means 110 has an inner shaft 111, an upper piston 112, a lower piston 113, an upper annular shoulder 114, a lower annular shoulder 115, an upper bulkhead 116, and a lower bulkhead 117.

Upper chamber 120 is filled with a nitrogen charge such as 3000 p.s.i., which pressure is increased as the bulkhead 116 is moved up to reduce the size of chamber 120. Chamber 121 is filled with fluid which will be sent to other equipment such as the blowout preventer devices as discussed in FIG. 1. Chamber 122 is vented thru line 123 and balloon 124 to the sea water pressure. Chamber 125 is filled with a low pressure or a vacuum.

Assuming that the area of the inner shaft 111 is 10 percent of the area of the large bore 105, the pressure in chamber 121 will be intensified by 10 percent over the precharge in chamber 120, irrespective of the sea water depth of the accumulator application. If the accumulator would be placed in seawater slightly more than 6000 feet deep, the ambient pressure would be 3000 p.s.i. and the pressure in chamber 121 would be 3000 p.s.i., making the accumulator ineffective. This paragraph has described the operation of a conventional accumulator, irrespective of whether it is a bladder type, piston type, or float type.

Now if the ambient pressure of the sea water is introduced into chamber 122 and pulls the inner shaft 111 down with the lack of resistance from a vacuum in chamber 125. The pressure in the chamber 121 will be increased exactly as the pressure in chamber 122 is increased. By this means of automatically increasing the pressure in the chamber 121 according to the increases in ambient pressure, a 3000 p.s.i. initial pressure at the surface will be a 3000 p.s.i. pressure differential at 6000 feet of sea water. This style accumulator closely maintains a constant pressure differential with respect to the ambient pressure, irrespective of the actual depth in sea water of the accumulator.

The foregoing disclosure and description of this invention are illustrative and explanatory thereof, and various changes in the size, shape, and materials as well as the details of the illustrated construction may be made without departing from the spirit of the invention.

I claim:

1. An accumulator for subsea drilling systems for the purpose of using the inherent pressure of seawater as an energy storage means, comprising a body having a small internal bore with a bulkhead, a large internal bore, and a first annular shoulder between said small internal bore and said large internal bore, a ram having a small external diameter suitable to sealingly engage said small internal bore of said body, a small end, a large external diameter suitable for sealingly engaging said large internal bore of said body, a large end, and a second annular shoulder between said small external diameter and said large external diameter, a first cavity defined by said bulkhead, said small internal bore and said small end, a second cavity defined by said large internal bore, said small external diameter, said first annular shoulder and said second annular shoulder, such that when the seawater pressure is applied to said large end of said ram and a lower pressure than the pressure of said seawater is in either said first cavity or said second cavity, a higher pressure than said seawater pressure results in the other of said first cavity or said second cavity.

2. The invention of claim 1, wherein a volume of fluid may be introduced into the other of said first or second cavity for storage at said higher pressure.

3. The invention of claim 2, wherein said fluid stored in said other of said first or said second cavity can be withdrawn without losing pressure due to the expansion of a pressurized gas.

4. The invention of claim 2, wherein said fluid stored in said other of said first or said second cavity can be withdrawn without losing pressure due to the cooling effect of expanding a pressurized gas.

5. The invention of claim 1, wherein said lower pressure is a vacuum or atmospheric pressure.

6. The invention of claim 1, wherein said higher pressure in said other of said first cavity or said second cavity is approximated by the pressure of the seawater times the area of the larger end divided by the area of said second or said first cavity.

7. The invention of claim 6, wherein fluid stored at said higher pressure in said other of said first cavity or said second cavity can be withdrawn without losing pressure due to the expansion pressure loss of a pressurized gas or the cooling effect of expanding a pressurized gas.

8. An accumulator for subsea drilling systems for the purpose of using the inherent pressure of seawater as an energy storage means, comprising a body having a small internal bore with a first and a second annular shoulder at each end of said small internal bore, a first large internal bore on a first end closed by a first bulkhead, and a second large internal bore on a second end closed by a second bulkhead, a ram having a central portion with a small external diameter suitable to sealingly engage said small internal bore of said body, a first piston proximate a first end of said central portion of a diameter suitable to sealingly engage said first large internal bore of said body, and a second piston proximate a second end of said central portion of a diameter suitable to sealingly engage said second large internal bore of said body, a first cavity formed by said first bulkhead, said first large bore, and said first piston, a second cavity formed by said central portion of said ram, said first annular shoulder, said first large bore, and said first piston, a third cavity formed by said central portion of said ram, said second annular shoulder, said second large bore, and said second piston, a fourth cavity formed by said second bulkhead, said second large bore, and said second piston, such that said first cavity is precharged with a pressurized gas, said fourth cavity is pressurized with a low pressure or a vacuum, and seawater pressure is communicated into said third cavity, such that the pressure of fluid in said second cavity will be generally proportionate to the sum of the pressure of said pressurized gas in said first cavity plus said seawater pressure in the third chamber minus the low pressure of vacuum in said fourth chamber.

9. The invention of claim 8, wherein a volume of liquid can be pumped into said second cavity for storage at a pressure higher than said seawater pressure for future use.

10. The invention of claim 8, wherein said low pressure is a vacuum or atmospheric pressure.

11. The invention of claim 8, wherein said pressure of said fluid in said second cavity is equal to the differential pressure between said pressurized gas in said first cavity and said low pressure or vacuum in said fourth cavity times the area of said first large bore divided by the area of said first annular shoulder, plus the pressure in said third cavity.

12. The invention of claim 8, wherein the diameter of said small internal bore and said central portion of said ram are approximately 31.6% of the diameter of said first large internal bore and said first piston such that the pressure of fluid in said second cavity is 110% of the pressure in said first cavity plus the said seawater pressure in said third cavity.

13. The invention of claim 8, wherein when fluid is introduced in said second cavity for storage, fluid expelled from said third cavity is communicated into a resilient storage means to keep said fluid from mixing from said seawater.

14. The method of operating subsea equipment having one or more pistons by communicating ambient seawater pressure onto a first piston area and communicating pressure less than seawater pressure onto a second piston area, wherein said pressure less than seawater pressure is communicated to a first piston area to move an operated device in a first direction from a first position to a second position, and then said pressure less than seawater pressure is applied to said second piston area to return said operated device back to the first position.

15. The method of operating subsea equipment having one or more pistons by communicating ambient seawater pressure onto a first piston area and communicating pressure less than seawater pressure onto a second piston area, wherein the pressure differential between said first piston area and said second piston area does not decline or increase due to the expansion or compression of a pressurized gas.

16. The method of operating subsea equipment having one or more pistons by communicating ambient seawater pressure onto a first piston area and communicating pressure less than seawater pressure onto a second piston area, wherein the pressure differential between said first piston area and said second piston area does not decline due to the cooling effect of expanding a pressurized gas or increase due to the heating effect of compressing a pressurized gas.

17. The method of operating subsea equipment having one or more pistons by communicating ambient seawater pressure onto a first piston area and communicating pressure less than seawater pressure onto a second piston area, wherein the pressure differential between said first piston area and said second piston area does not decline or increase due to the expansion or compression of a pressurized gas or the cooling or heating effect of expanding or compressing of a pressurized gas.

* * * * *